United States Patent [19]

Yamaguchi

[11] Patent Number: 4,991,487

[45] Date of Patent: Feb. 12, 1991

[54] AUTOMATIC MUSICAL ACCOMPANIMENT SOUND GENERATING APPARATUS

[75] Inventor: Yorihisa Yamaguchi, Hamamatsu, Japan

[73] Assignee: Yamaha Corporation, Hamamatsu, Japan

[21] Appl. No.: 373,045

[22] Filed: Jun. 27, 1989

[30] Foreign Application Priority Data

Jun. 28, 1988 [JP] Japan ..... 63-160555

[51] Int. Cl.[5] ..... G10H 1/42

[52] U.S. Cl. ..... 84/714

[58] Field of Search ..... 84/610, 611, 612, 634, 84/635, 636, 650, 651, 652, 666, 667, 668, 712, 713, 714

[56] References Cited

U.S. PATENT DOCUMENTS 4,887,505 12/1989 Suzuki ..... 84/714

4,936,184 6/1990 Yang ..... 84/612

*Primary Examiner*—W. B. Perkey

*Attorney, Agent, or Firm*—Spensley, Horn, Jubas & Lubitz

[57] ABSTRACT

The present invention provides an automatic musical-accompaniment sound-generating apparatus for generating various accompaniment sounds. The original accompaniment patterns stored in the apparatus are varied according to the tempo of the accompaniment being produced. The apparatus is essentially composed of an accompaniment-pattern memory, accompaniment control memory, a tempo generator, a sound generation controller, accompaniment-sound signal generating means, and a sound system. The accompaniment-pattern memory stores data sets composed of sound data. The data sets correspond to original accompaniment patterns. The sound data correspond to musical notes and sounds composing the original accompaniment pattern. The accompaniment control memory stores control data about whether or not to generate each of the musical notes and sounds in relation with the tempo at which the accompaniment sounds are produced. The tempo generator generates tempo signals. The sound generation controller is activated by tempo signals and reads the sound data and decides whether or not to transmit the sound data according to the tempo at which the accompaniment sound is being generated. The accompaniment sound signal-generating means generates accompaniment sound signals according to the sound data transmitted by the sound generation controller. The sound system emits accompaniment sounds according to the accompaniment sound signals.

9 Claims, 6 Drawing Sheets

AUTOMATIC MUSICAL ACCOMPANIMENT SOUND GENERATING APPARATUS

BACKGROUND OF THE INVENTION

1. Field of the Invention

The field of the present invention is related to an apparatus for automatically generating accompaniment sounds for music. The accompaniment sounds to be generated are percussion sounds such as cymbal sounds and drum sounds, and melodious sounds such as arpeggio sounds and bass sounds.

2. Prior Art

Automatic accompaniment sound-generating apparatuses have been used for automatically generating accompaniment sounds to accompany musical sounds played by musicians. An automatic accompaniment sound-generating apparatus generates accompaniment sounds according to instruction given by the operator and are based on information about accompaniment pattern, tempo, etc., stored therein.

A conventional automatic accompaniment sound-generating apparatus typically comprises an accompaniment-pattern memory, a tempo-setting means, a reading means, and an accompaniment signal generator. The accompaniment-pattern memory stores information about accompaniment patterns for percussion sounds and melodious sounds according to which the accompaniment sounds are generated. In the production of percussion sounds, the information comprises the generation timing pattern and the sounds which correspond to percussion musical instruments such as cymbals, drums, etc. In the production of melodious sounds, the information comprises generation timing, sound pitch, and tone color, corresponding to melodious musical instruments such as the piano, guitar, etc. The tempo-setting means sets the tempo, according to which the speed of the accompaniment sound generation is controlled. The reading means reads out the information stored in the accompaniment-pattern memory at a speed indicated by the tempo stored in the tempo-setting memory. The accompaniment sound generator generates accompaniment sounds according to the accompaniment pattern information read out by the reading means.

A problem of the conventional automatic accompaniment sound-generating apparatus is that the accompaniment sounds generated by the apparatus tend to be monotonous because the accompaniment pattern is unchanged even when the tempo is changed. Another problem is that the accompaniment sounds sometime become too infrequent and thereby uninteresting when the tempo is slow. Conversely, when the tempo is fast, the accompaniment sounds tend to overlap and interfere one another. Therefore, the operator had to alter accompaniment patterns according to the tempo in order to avoid the problems mentioned above. Furthermore, if various accompaniment patterns are to be stored to avoid the inconvenience mentioned above, the memory necessary for it becomes enormous and impractical.

SUMMARY OF THE INVENTION

An object of the present invention is to avoid the above-mentioned problems of conventional automatic accompaniment sound-generating apparatus had. The improvement is obtained by automatically changing the accompaniment pattern according to the tempo of the accompaniment sound being performed.

To this end, an automatic accompaniment sound-generating apparatus according to the present invention modifies the accompaniment pattern information read out of a pattern memory, according to the tempo of the accompaniment sound being generated, and the modified pattern information is used for generating the accompaniment sounds.

The automatic accompaniment sound-generating apparatus according to an aspect of the present invention is typically composed of a pattern memory, a control memory, a reading means, a control information generator, a control means and an accompaniment sound signal generator. The pattern memory stores information about the accompaniment patterns. The control memory stores control information about whether to modify the accompaniment patterns according to the tempo. The reading means reads pattern information from the pattern memory and control information from the control memory. The control information generator generates information about whether to modify the accompaniment pattern. The control means controls the generation of the accompaniment signal. The accompaniment signal generator generates signals about accompaniment sounds in accordance with the information about accompaniment pattern, tempo and control.

Further objects and effects of the present invention will be made clear through the following description.

DETAILED DESCRIPTION OF THE PREFERRED EMBODIMENTS

Figure 1:
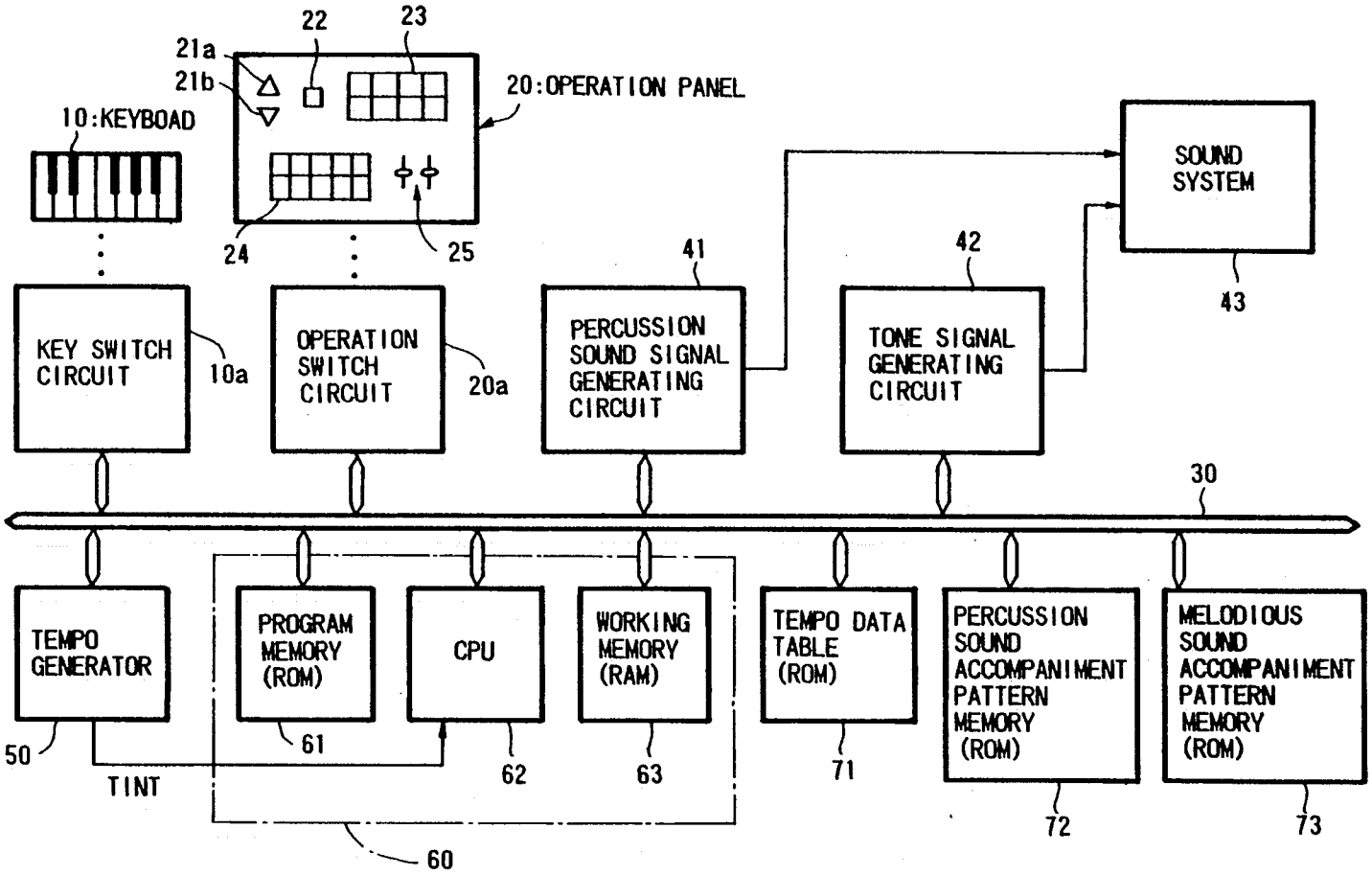
FIG. 1 is a flow diagram showing an embodiment of the present invention.

The function of a preferred embodiment of the automatic accompaniment generating apparatus according to the present invention is schematically represented by the flow diagram shown in FIG. 1. The apparatus has a keyboard 10 and an operation panel 20. The keyboard 10 comprises keys and the operation of the keys is detected by the corresponding key switches disposed in a key switch circuit 10*a* and connected to the keys. The operation panel 20 comprises an up-tempo operator 21*a* for increasing the tempo; down-tempo operator 21*b* for decreasing the tempo; start/stop switch 22; rhythm selectors 23 for selecting a rhythm such as a march, a waltz, etc.; musical tone color selector 24 for selecting tone colors of melodious accompaniment sounds such as arpeggio and bass; and volume controllers 25 for separately controlling the volume of each type of the sound. Operation of the selectors mentioned above is detected by the corresponding switches connected thereto and disposed in the operation switch circuit 20*a*. The key-switch circuit 10*a* and the operation switch circuit 20*a* are connected to a bus 30.

A percussion-sound signal-generating circuit 41, a melodious-sound signal-generating circuit 42, a tempo generator 50, and a microcomputer are also connected to the bus 30. A sound system 43 having an amplifier and a loud speaker is connected to the percussion-sound signal-generating circuit 41 and the melodious-sound signal-generating circuit 42 to be driven thereby. The percussion-sound signal-generating circuit 41 comprises percussion-sound signal generators each of which generates one of the various percussion sounds such as that of cymbals, a bass drum, etc., and generates one or a plurality of percussion-sound signals according to tone code TC transmitted by the microcomputer 60 through the bus 30.

The melodious-sound signal-generating circuit 42 comprises channels each of which generates sound signals of, for example, a piano, a violin, etc. The circuit 42 generates melodious-sound signals according to the information about the musical tone color and key code KC, both transmitted by the microcomputer 60 through the bus 30. The percussion-sound signals and the melodious-sound signals generated by the circuits 41 and 42 are transmitted to the sound system 43 to generate accompaniment sounds corresponding thereto.

The tempo generator 50 generates tempo clock signals according to tempo data TEMP transmitted by the microcomputer through the bus 30. The tempo signals TINT are transmitted to the microcomputer 60 from the tempo generator and are regarded as interruption signals by the microcomputer 60.

The microcomputer is mainly composed of a program memory (ROM) 61, a central processing unit (CPU) 62 and a working memory (RAM) 63. The program memory 61 stores a main program, sub-programs and a tempo-interruption program on a ROM (FIGS. 4 through 7). The CPU 62 starts the main program when the main switch (not shown) is turned on, continues to run the main program repeatedly while the main switch is on, and allows the interruption program to interrupt the main program when the interruption signal TINT is transmitted from the tempo generator 50. The working memory temporarily stores the following data and flags necessary for executing the programs on a RAM.

Run Flag RUN: designates the operational status of the automatic accompaniment sound generation; "1" for operation and "0" for non-operation.

Rhythm Type RHY: designates the type of rhythm being selected.

Tempo Data TEMP: designates the tempo of the automatic accompaniment. ($0<TEMP<63$)

Slow-Tempo Threshold Data TPLO: designates the lower threshold tempo of the selected rhythm type. ($0<TPLO<TPHI$)

Fast-Tempo Threshold Data TPHI: designates the higher threshold tempo of the selected rhythm type. ($TPLO<TOHI<63$)

Standard Tempo Data TPST: designates the standard tempo of the selected rhythm type.

Tempo Group Data TPGP: designates one of the classes of tempo to which the current status belongs; "1" for slow tempo lower than TPLO, "2" for medium-tempo between TPLO and TPHI, and "3" for fast tempo higher than TPHI.

Tempo Count Data TCNT: designates the number of interruption events caused by the signal TINT for indicating the current sequence of the musical accompaniment and the address in the percussion sound pattern memory 72 and the melodious sound pattern memory 73. ($0<TCNT<31$)

Root Sound Data ROOT: designates the root notes of the chord performed by the keyboard 10.

Chord Type Data TYPE: designates the type, such as the major or minor of the chord performed by the keyboard 10.

A tempo data table (ROM) 71, a percussion-sound accompaniment-pattern memory (ROM) 72, and a melodious-sound accompaniment-pattern memory (ROM) 73, are also connected to the bus 30. The tempo data table 71 stores the slow-tempo threshold at which the medium-tempo and the slow-tempo are separated from each other, the fast-tempo threshold at which the medium-tempo and the fast-tempo are separated from each other and the standard tempo, corresponding to the type of rhythm.

The percussion-sound accompaniment-pattern memory 72 stores percussion-sound data RD at the addresses corresponding to each value (0–31) of the tempo-count data TCNT. The percussion-sound data RD is composed of a tempo flag TPFLG and a tone code TC. The following meanings are attached to each value of the tempo flag TPFLG: "0" for permitting the generation of percussion sounds regardless of the tempo; "1", "2" and "3" for prohibiting the generation of percussion sounds at slow tempo, medium tempo and fast tempo, respectively. The tone code TC designates the type of percussion sound. When a non-operation indicator NOP is indicated by the tone code TC, generation of the percussion sound is not allowed.

Figure 3:
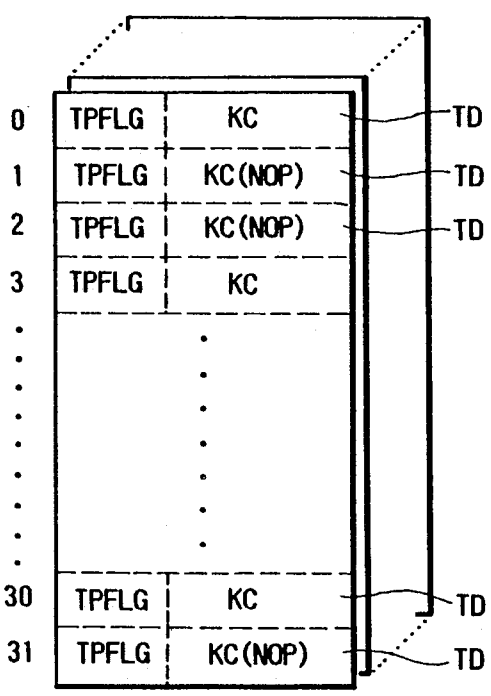
FIG. 2 and FIG. 3 show memory maps of accompaniment pattern memories.
Figure 2:
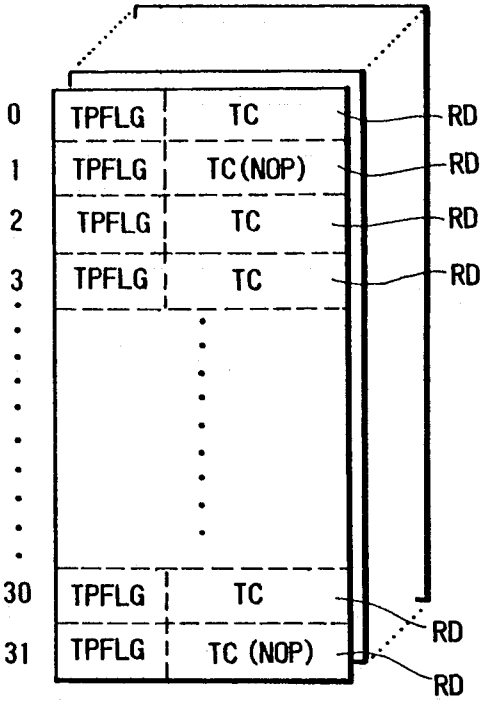

As shown in FIG. 3, melodious sound accompaniment pattern memory 73 is composed of a plurality of data sets. Each of the data sets has addresses corresponding to the tempo count data TCNT ($0<TCNT<31$) for storing melodious sound data TD such as arpeggio and bass sounds. The melodious sound data TD is composed of a tempo flag TPFLG and the key code KC. The values of the tempo flag TPFLG are: "0" for permitting the generation of melodious sounds regardless of the tempo; "1", "2" and "3" for prohibiting the generation of melodious sounds at slow tempo, medium tempo, and fast tempo, respectively. The key code KC designates the musical interval of the tone from the tone of C. When a nonoperation indicator NOP is indicated by the tone code TC, none of the melodious sounds is designated thereby, that is, the generation of the melodious sounds is prohibited.

Operation of the embodiment mentioned above will be described as follows.

Figure 4:
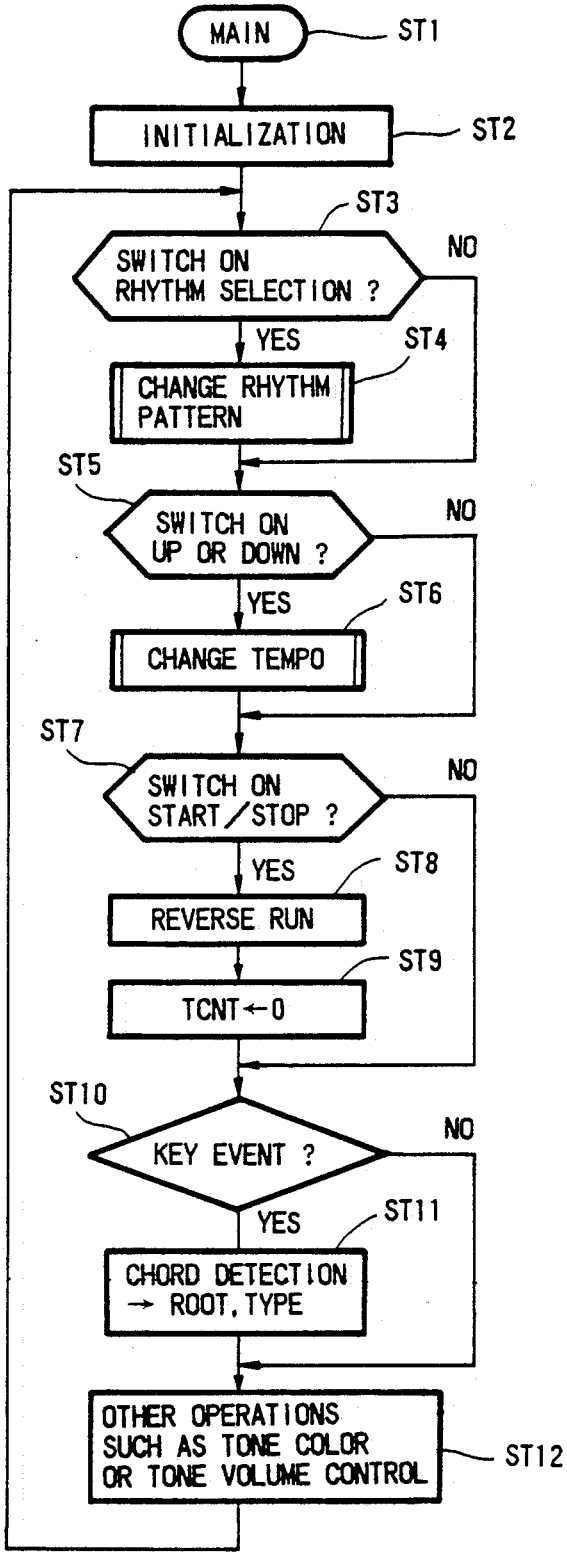
FIG. 4 through FIG. 7 are flow charts showing the programs to be used in the microcomputer according to an embodiment of the present invention.

When the main switch is turned on, the CPU 62 starts the main program from step ST1 as shown in FIG. 4 and initializes data in the working memory 63 at subsequent step ST2. Then, the main program loops repeatedly between steps ST3 through ST12 according to the operation of the keyboard 10 and the operation panel 20.

At steps ST3 and ST4, rhythm type of the accompaniment is altered according to the operation of the rhythm selectors according to the following procedure.

Figure 5:
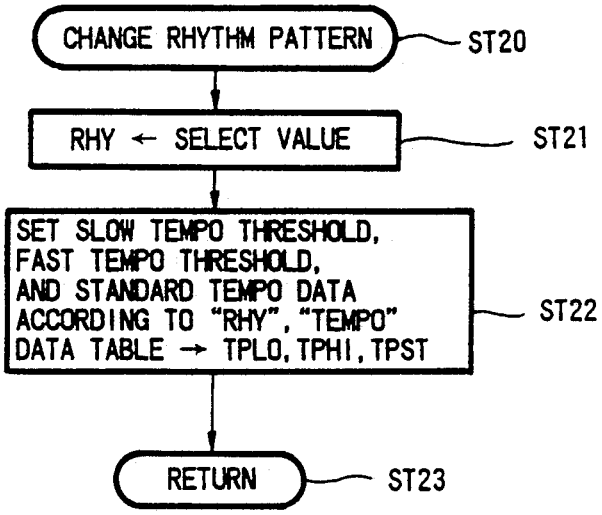
Figure 6:
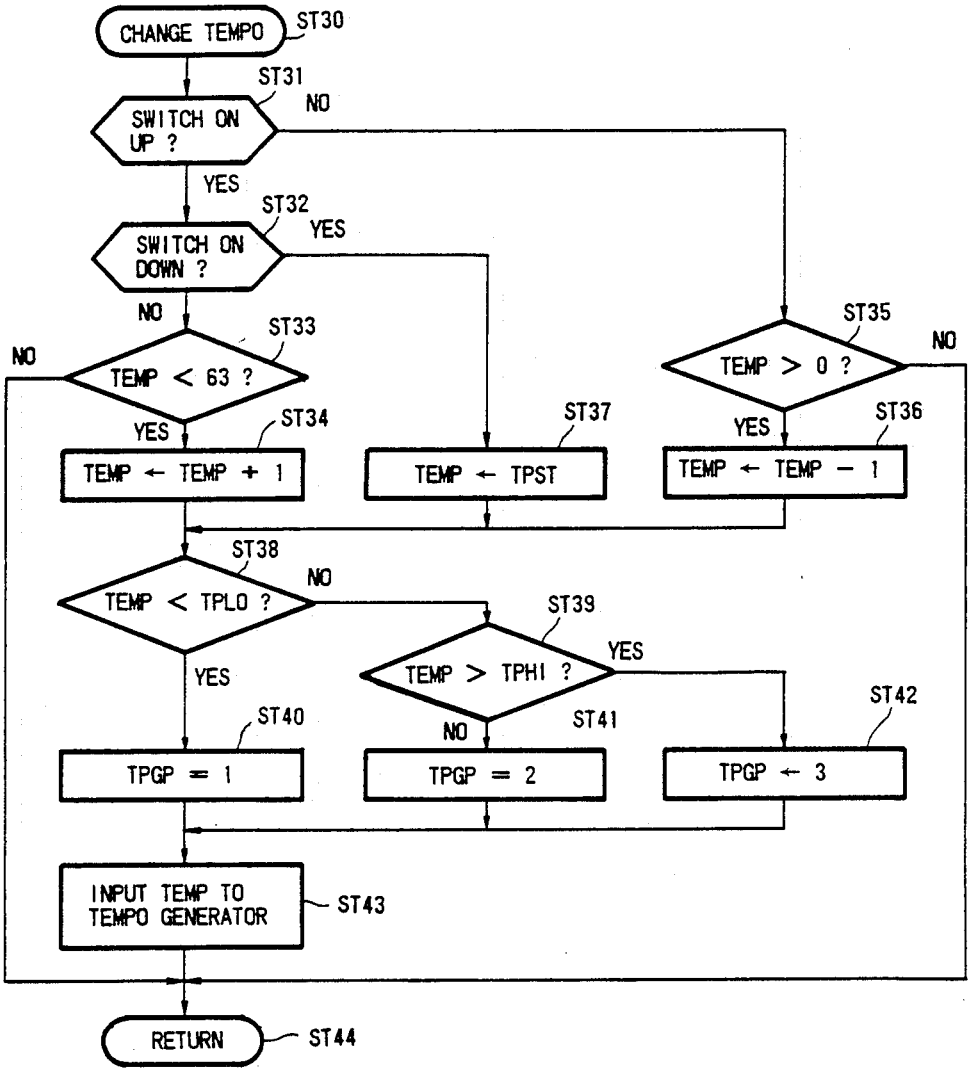

At step ST3, operation of the rhythm selectors 23 is detected. When at least one of the rhythm selectors 23 is operated, the decision at step ST3 is "yes" and a rhythm change routine is performed at step ST4. When none of the rhythm selectors 23 is operated, the judgement is "no" and the rhythm change routine at step ST4 is bypassed to go directly to step ST5. FIG. 5 shows the operation in the rhythm change routine. The routine starts at step ST20. Then the rhythm type data RHY is altered to a value corresponding to the type of rhythm selected by the rhythm selector 23. At the subsecuent step ST22, the slow-tempo threshold, the fast-tempo threshold, and the standard tempo, according to the rhythm type data RHY are read out of the tempo data table 71. The tempo data mentioned above are stored as a slow-tempo threshold TPLO, fast-tempo threshold TPHI and a standard tempo TPST, respectively. After this operation, control proceeds to step ST23 at the end of the rhythm change routine and the control is returned to step ST5 of the main program.

In steps ST5 and ST6, the tempo of the accompaniment is altered according to the operation of the up-tempo operator and the down-tempo operator. When both the operators are switched on simultaneously, the tempo of the accompaniment is set to a standard tempo. The operation is described as follows.

In step ST5, operation of the up-tempo operator 21*a* and the down-tempo operator 21*b* is detected. When either the up-tempo operator 21*a* or the down-tempo operator 21*b* is operated, the judgement at the step ST5 is "yes", and the change-tempo routine is performed at step ST6. When none of the operators 21*a* and 21*b* is operated, the judgement is "no" and the control proceeds to step ST7, bypassing step ST6. Operation of the change tempo routine is diagramatically shown in FIG. 6. The routine starts from step ST30 followed by steps ST31 and ST32, which detect the operation of the up-tempo operator and the down-tempo operator, respectively. When the up-tempo operator is not operated or when the down-tempo operator is operated, the control jumps to steps ST35 and ST37 respectively. Otherwise, that is, when the up-tempo operator is on and the down-tempo operator is off, the control proceeds to step ST33. AT step ST33, if TEMP is less than 63, the control proceeds to step ST34. When TEMP is equal to or larger than 63, the control jumps to step ST44, the change-tempo routine finishes and the control returns to the main program. When TEMP is lower than 63 at step ST33, TEMP is incremented by 1 and the sum is stored as TEMP at step ST34. Then the control proceeds to step ST38. When the up-tempo operator is not operated, that is when only the down-tempo operator is operated, the judgement at step ST31 is "no" and the control proceeds to step ST35. At step ST35, tempo data TEMP is compared to zero. When the tempo data TEMP is greater than 0, the tempo data TEMP is decremented by 1 and the new value is stored as the tempo data TEMP. Then the control proceeds to step ST38. When the tempo data is zero at step ST35, the control jumps to step ST44 without altering the tempo data TEMP and returns to the main program. When both the up-tempo operator 21*a* and the down-tempo operator 21*b* are operated, that is when the judgement at step ST31 and step ST32 are both "yes", the control proceeds to step ST37. At step ST37, the tempo data TEMP is replaced by the standard tempo data TPST. As a result of the operations mentioned above, when only the up tempo switch is on, the value of tempo data TEMP is incremented by 1. When only the down-tempo operator is on, the value of tempo data TEMP is decremented by 1. When both the up-tempo and down-tempo operators are on, a standard tempo is given to the tempo data TEMP.

After the alteration of the tempo data TEMP mentioned above, the tempo-group data TPGP, indicating the current class of the tempo such as slow tempo, medium tempo and fast tempo, is altered in steps ST38 through ST42 as follows.

At step ST38, the tempo data TEMP is compared with the low-tempo threshold TPLO. When the tempo data TEMP is less than the low-tempo threshold TPLO, the tempo group data is set to be 1 at step ST40 and control proceeds to step ST43. When the tempo data TEMP is equal to or larger than the low-tempo threshold TPLO, then the tempo data is compared with high-tempo threshold TPHI at step ST39. When the tempo data TEMP is not larger than the higher threshold TPHI, tempo group data is set to be 2 at step ST41 and control proceeds to step ST43. When the tempo data TEMP is larger than the high-tempo threshold TPHI, the tempo group data becomes 3 at step ST42 and control proceeds to step ST43. When step ST43 is performed, the tempo group data has one of the values "1", "2" or "3" according to the current tempo TEMP compared to the threshold values. At step ST43, the tempo data TEMP is output to the tempo generator 50 through the bus 30. On receiving the tempo data, the tempo generator 50 outputs an interruption signal to the CPU 62 at a time interval corresponding to the tempo data TEMP. After step ST43, the control proceeds to step ST44 and returns to step ST7 of the main program.

Start and stop of the accompaniment sound generation is controlled in steps ST7 through ST9 as follows.

At step ST7, operation of the start/stop switch 22 is detected. When switch 22 is operated, it is judged "yes" at step ST7 and run flag RUN is reversed at the succeeding step ST8. To reverse the flag RUN means to change the run flag RUN from "0" and "1" and vice versa at each event. The run flag RUN designates the operational status of the automatic accompaniment sound generation; "1" for operation and "0" for non-operation. At step ST9 subsequent to step ST8, tempo count data TCNT is cleared to zero. When the start/-stop switch is not operated, the judgement is "no" and steps ST8 and ST9 are bypassed.

Notes or chords played on the keyboard are detected and their root note and the chord type are stored in steps ST10 and ST11.

At step ST10, operation of keyboard 10 is detected. When at least one of the keys of the keyboard 10 is operated, the judgement at step ST10 is "yes" and control proceeds to step ST11. At step ST11, the chord being operated is detected and key code ROOT designating the root of the chord and data TYPE indicating the type of the chord, such as major or minor, are stored. If the keyboard is not operated, the judgement at step ST10 is "no" and step ST11 is bypassed.

Other operations such as sound volume control, tone color change, etc., are performed at step ST12 as follows.

Operation of the tone-color selectors 24 and the sound volume operators 25 is detected at step 12. If at least one of the selectors 24 and the operators 25 is operated, information about tone colors and sound volumes corresponding to the operation is stored.

After step ST12, control returns to step ST3 and repeats the operations mentioned above.

At the interruption routine shown in FIG. 1, if the run flag RUN is "1", signals are sent to the percussion sound-generation circuit and the melodious sound-generation circuit to trigger them for generating sound signals. If the run flag RUN is "0", the interruption routine is substantially bypassed without triggering the sound-generation circuits. This procedure is described as follows.

Figure 7:
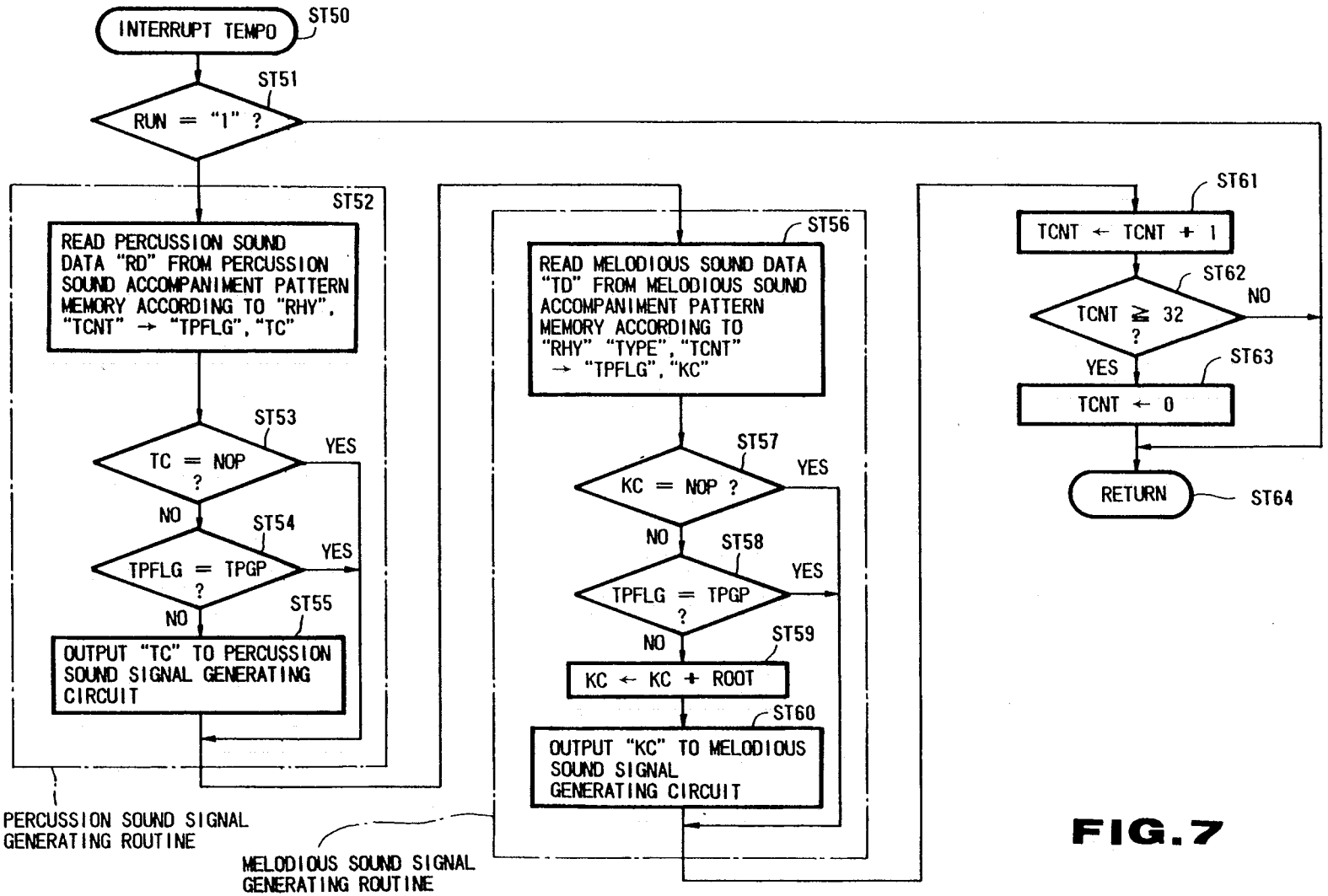

When the CPU 62 receives an interruption signal TINT from the tempo generator 50, the control jumps to an interruption routine shown in FIG. 7 regardless of which part of the main program is being executed at that time. In the interruption routine, operation starts at step ST50. Then, the run flag RUN is examined. If the run flag RUN is "1", the judgement at step ST51 is "yes" and the procedures from ST52 through ST63 are performed as described below. When the run flag RUN is "0" at step ST51, the judgement at step ST51 is "no" and the control jumps to step ST64 and returns to the main program. The procedures corresponding to steps ST52 through ST63 are composed of a percussion sound-generating routine composed of steps ST52 through ST55, and a melodious sound-generating routine composed of steps ST56 through ST60. At step ST52, percussion-sound data RD comprising tempo flag TPFL and tone code TC are read out of the percussion-sound accompaniment-pattern memory 72 according to the rhythm type data RHY and the tempo count data TCNT. At the succeeding step ST53, the tone code TC is compared with the number NOP. If the tone code TC is identical to the number NOP, control bypasses the following two steps and proceeds to step ST56 without triggering the percussion sound-generating circuit. If the tone code TC is different from the number NOP, the tempo flag TPFLG is compared with the tempo group data TPGP at step ST54. If the tempo flag TPFLG is identical to the tempo group data TPGP, control jumps to step ST56, again without triggering the percussion sound-generating circuit. If the tempo flag TPFLG is different from the tempo-group data TPGP, the tone code TC is transmitted to the percussion sound-generating circuit 41 through the bus 30. Consequently, the percussion sound-generating circuit 41 generates musical sound signals of corresponding percussion according to the tone code TC and transmits the signal to the sound system 43. Thus, percussion sounds are emitted by the sound system 43.

When several percussion sound data RD are detected at the same time, procedures in the percussion-sound signal-generating routine composed of steps ST52 through ST55 is repeated as many times as the number of the percussion sound data RD. According to the procedure mentioned above, percussion sounds are emitted only when the run code RUN is 1, the tone code TC is not NOP and the tempo flag TPFLG is not tempo group TPGP.

At step ST56, melodious-sound data TD composed of the tempo flag TPFLG and the key code KC are read out of the melodious-sound pattern memory 73 according to the rhythm type data RHY, type data TYPE and tempo data TCNT. At step ST57, the key code KC is compared with the number NOP. If the key code KC is equal to the number NOP, the judgement is "yes" and control jumps to step ST61, bypassing steps ST58 through ST60, without triggering the melodious sound-generating circuit 42. If the key code KC is different from the number NOP, the judgement is "no" and the tempo flag TPFLG is compared with the tempo group TPGP at subsequent step ST58. If the tempo flag TPFLG is equal to tempo TPGP, control again jumps to step ST61 bypassing steps ST59 and ST60, without triggering the melodious sound-generating circuit 42. If tempo flag TPFLG is not equal to tempo group TPGP, new key code is calculated by adding data designating root tone of the current chord ROOT and the key code KC, and the new key code KC is outputted to the melodious-sound signal-generating circuit 42. The melodious-sound signal-generating circuit 42 generates melodious-sound signals, which correspond to arpeggio, bass, etc., according to the key code KC, and transmits the signal to the sound system 43. Consequently, melodious accompaniment sounds are emitted by the sound system. Similarly, as in the generation of the percussion sounds, the generation of the melodious sound is suppressed when the key code is equal to the number NOP or the tempo flag TPFLG is equal to the tempo group TPGP. Therefore, the generation pattern of the melodious accompaniment sound is controlled according to the tempo of the accompaniment. The procedure of the melodious-sound signal-generating routine, including steps ST56 through ST60 is repeated as many times as the number of melodious sound data TD.

After at least one of the percussion-sound signal-generating routine and the melodious-sound signal-generating routine is performed, tempo-count data is incremented by 1 at step ST61. Then, the new tempo-count data is compared with 32. When the tempo count data TCNT is less than 32, control jumps to step ST64 and returns to the main program. When the tempo count data TCNT is equal to or greater than 32, the tempo count data TCNT is cleared to zero at step ST63 and control returns to the main program. Therefore, the tempo count data TCNT is incremented by 1 in each event of tempo interruption until it reaches 32, cleared to zero when it reaches 32, and repeats the same thing. If the run flag RUN is "0", the interruption program starts by the interruption signal TINT but the main part of the procedure is bypassed according to the judgement of "no" at step ST51. Therefore, in this case neither the percussion sounds nor the melodious sounds are generated.

According to this embodiment of the present invention, the generation pattern of the percussion sound and the melodious sound is altered according to the tempo flag TPFLG and the tempo group data TPGP. Because the tempo flag TPFLG is predetermined according to the rhythm type and the tempo-group data designates the current status in terms of tempo, the above performance results in a natural and variable performance of accompaniments in which the accompaniment pattern is automatically varied according to the tempo of the accompaniment sound. Because the tempo flag TPFLG is included in the percussion-sound data RD and the melodious sound data TD, memory for storing the tempo flag is not necessary. Therefore, total memory requirements of the percussion-sound pattern memory 72 and the melodious-sound pattern memory 73 are reduced. According to the present embodiment, the total memoty requirement is reduced by far compared to a system which stores all the possible accompaniment patterns, because various accompaniment sounds can be produced from relatively limited number of accompaniment patterns.

The tempo flag TPFLG may be stored independently of the tone code TC and the key code KC as long as the tempo flag TPFLG can be read out together with the tone code TC and the key code KC.

The tempo flag TPFLG may be composed of three-bit data, each bit corresponding to the slow tempo, medium-tempo and fast tempo in generating percussion-accompaniment sounds and melodious accompaniment sounds. The tempo of the accompaniment may be categorized into two or more than three categories. In such a case also, the number of bits of data necessary corresponds to the number of categories.

The percussion-sound data RD and melodious-sound data TD may be changeable when the percussion sound pattern memory 72 and the melodious sound pattern memory 73 are stored in RAMs and the percussion-sound data RD and the melodious sound data TD are copied from a ROM at the initial stage of the program. The percussion sound data RD and the melodious sound data TD may be written on the RAMs according to an operation of the operator.

Tempo of the accompaniment may be according to both the rhythm type and chord type. In such a case, rhythm types and chord types should be stored in the tempo table 71, and they should be read out from the table 71 at step ST22 (FIG. 5) according to both the rhythm type data RHY and type data TYPE.

Accompaniment sound is not restricted to the sounds mentioned in the above description, and any sounds may be used as long as the sounds are generated according to the accompaniment pattern.

What is claimed is:

1. An automatic musical-accompaniment sound-generating apparatus for generating various accompaniment sounds, the apparatus comprising:

(a) memory means for storing data sets being composed of accompaniment sound data and control data, the accompaniment sound data composing the original accompaniment pattern, control data corresponding to information about whether to generate each of accompaniment sounds corresponding to the accompaniment sound data in relation with the current tempo at which the accompaniment sounds are produced;

(b) a tempo generator for generating tempo signals;

(c) accompaniment sound generating means for reading the data sets according to tempo signals, deciding whether to transmit the accompaniment sound data on the basis of the control data and the tempo;

(d) a sound system for emitting accompaniment sounds according to the accompaniment-sound data, whereby the current accompaniment patterns are varied from the original accompaniment patterns and the variation depends on both the current tempo and the original pattern.

2. An automatic musical-accompaniment sound-generating apparatus according to claim 1 which comprises two accompaniment-pattern memories one of which stores data sets corresponding to original accompaniment patterns of percussion accompaniment sounds and control data thereof, and the other of which stores data sets corresponding to original accompaniment patterns of melodious accompaniment sounds and control data therefor.

3. An automatic musical-accompaniment sound-generating apparatus, according to claim 1 wherein the control data includes at least one tempo threshold value and a comparison of the tempo threshold value and the current tempo determines whether or not to generate the accompaniment sounds.

4. An automatic musical accompaniment sound-generating apparatus according to claim 3 wherein there are two tempo threshold values and the tempo is placed into one of three classes demarcated by the two tempo threshold values; higher than both, in between, and lower than both threshold tempo values.

5. An automatic musical-accompaniment sound-generating apparatus for generating various accompaniment sounds, the apparatus comprising:

(a) at least one accompaniment-pattern memory for storing sound data corresponding to musical notes and sounds composing the original accompaniment pattern;

(b) at least one accompaniment control memory for storing control data about whether or not to generate each of the musical notes and sounds in relation with the current tempo at which the accompaniment sounds are produced;

(c) a tempo generator for generating tempo signals;

(d) a sound generation controller activated by tempo signals for reading the sound data, deciding whether or not to transmit the sound data according to the tempo at which the accompaniment sound is being generated;

(e) at least one accompaniment-sound signal-generating means for generating accompaniment-sound signals according to the sound data transmitted by the sound generation controller;

(f) a sound system for emitting accompaniment sounds according to the accompaniment sound signals, whereby the current accompaniment patterns are varied from the original accompaniment patterns and the variation depends on both the current tempo and the original pattern.

6. An automatic musical-accompaniment sound-generating apparatus according to claim 5 which comprises:

(a) two accompaniment pattern memories, one of which stores the sound data corresponding to original accompaniment patterns of percussion accompaniment sounds, and the other of which stores the sound data corresponding to original accompaniment patterns of melodious-accompaniment sounds; and (b) two accompaniment-control memories for storing control data corresponding to the percussion-accompaniment sounds and the melodious-accompaniment sounds, respectively.

7. An automatic musical-accompaniment sound-generating apparatus according to claim 5 wherein the control data includes at least one tempo threshold value and a comparison of the tempo threshold value and the current tempo determines whether or not to generate the accompaniment sounds.

8. An automatic musical-accompaniment sound-generating apparatus according to claim 7 wherein there are two tempo threshold values and the tempo is placed into one of three classes, demarcated by the two tempo threshold values; higher than both, in between, and lower than both.

9. An automatic musical-accompaniment sound-generating apparatus for generating various accompaniment sounds, the apparatus comprising:

(a) at least one memory means for storing data sets each data set being composed of sound data and control data, the data sets corresponding to original accompaniment patterns, the sound data corresponding to musical notes and sounds composing the original accompaniment pattern, control data corresponding to information about whether or not to generate each of the musical notes and sounds in relation with the current tempo at which the accompaniment sounds are produced;

(b) a tempo generator for generating tempo signals;

(c) a sound generation controller activated by tempo signals for reading the sound data, deciding whether or not to transmit the sound data according to the tempo at which the accompaniment sound is being generated and the control data;

(c) at least one accompaniment-sound signal-generating means for generating accompaniment-sound signals according to the sound data transmitted by the sound-generation controller;

(d) a sound system for emitting accompaniment sounds according to the accompaniment-sound signals, whereby the current accompaniment patterns are varied from the original accompaniment patterns and the variation depends on both the current tempo and the original pattern.

* * * * *